US009817362B2

(12) United States Patent
Hirayama

(10) Patent No.: US 9,817,362 B2
(45) Date of Patent: Nov. 14, 2017

(54) ELECTRONIC DEVICE CONTROLLING POWER SUPPLY FOR COMMUNICATION AND IMAGE FORMING APPARATUS PROVIDED WITH SAME

(71) Applicant: KYOCERA Document Solutions Inc., Osaka (JP)

(72) Inventor: Hayato Hirayama, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/250,182

(22) Filed: Aug. 29, 2016

(65) Prior Publication Data

US 2017/0060083 A1 Mar. 2, 2017

(30) Foreign Application Priority Data

Aug. 31, 2015 (JP) ..... 2015-170689

(51) Int. Cl.

| | |
|---|---|
| ***G03G 21/00*** | (2006.01) |
| ***G03G 21/16*** | (2006.01) |
| ***G03G 15/08*** | (2006.01) |
| ***G03G 15/00*** | (2006.01) |

(52) U.S. Cl.

CPC ..... *G03G 21/1652* (2013.01); *G03G 15/0863* (2013.01); *G03G 15/80* (2013.01); *G03G 21/1657* (2013.01); *G03G 2215/0697* (2013.01); *G03G 2221/166* (2013.01)

(58) Field of Classification Search

CPC ..... G03G 15/80; G03G 15/0863; G03G 15/5004; G03G 21/1652; G03G 21/1657; G03G 21/1867; G03G 21/1882; G03G 21/1892; G03G 2215/0695;

(Continued)

(56) References Cited

U.S. PATENT DOCUMENTS

| | | | | |
|---|---|---|---|---|
| 6,285,836 | B1 * | 9/2001 | Kubota | G03G 21/1896 399/12 |
| 8,508,770 | B2 * | 8/2013 | Lee | G03G 21/1633 347/192 |
| 9,086,679 | B2 * | 7/2015 | Lee | G03G 15/0863 |

(Continued)

FOREIGN PATENT DOCUMENTS

| | | | |
|---|---|---|---|
| JP | 2001-022230 A | | 1/2001 |
| JP | 2002169429 A | * | 6/2002 |

(Continued)

*Primary Examiner* — Robert Beatty
(74) *Attorney, Agent, or Firm* — IP Business Solutions, LLC

(57) ABSTRACT

An image forming apparatus includes: a toner container, a reader and writer, a blocking control section, and a press mechanism. To the toner container, an RFID tag is attached. The reader and writer opposes the RFID tag. The press mechanism has a press member and a rotor reciprocally moving in an attachment and detachment direction of the toner container. The blocking control section permits power supply to the reader and writer when the press member has been pressed in conjunction with insertion of the toner container and the rotor in conjunction therewith has moved to a first tip position, and blocks the power supply to the reader and writer when the rotor has separated from the first tip position and has moved to a locking position.

7 Claims, 8 Drawing Sheets

(58) Field of Classification Search
CPC ..... G03G 2215/0697; G03G 2221/166; G03G 2221/1823; G03G 2221/1892
USPC ..... 399/12, 13, 31, 88, 90
See application file for complete search history.

(56) References Cited

U.S. PATENT DOCUMENTS

| | | | | |
|---|---|---|---|---|
| 2011/0091222 | A1* | 4/2011 | Kim | G03G 21/1633 399/9 |
| 2012/0062950 | A1* | 3/2012 | Lee | G03G 15/0863 358/1.15 |
| 2014/0301744 | A1* | 10/2014 | Tenjiku | G03G 21/1842 399/13 |

FOREIGN PATENT DOCUMENTS

| | | | | |
|---|---|---|---|---|
| JP | 2003271021 | A | * | 9/2003 |
| JP | 2006078994 | A | * | 3/2006 |
| JP | 2009210602 | A | * | 9/2009 |
| JP | 2013218306 | A | * | 10/2013 |
| JP | 2015-074895 | A | | 4/2015 |

* cited by examiner

ELECTRONIC DEVICE CONTROLLING POWER SUPPLY FOR COMMUNICATION AND IMAGE FORMING APPARATUS PROVIDED WITH SAME

INCORPORATION BY REFERENCE

This application claims priority to Japanese Patent Application No. 2015-170689 filed on Aug. 31, 2015, the entire contents of which are incorporated by reference herein.

BACKGROUND

This disclosure relates to an electronic device and an image forming apparatus, and more specifically to communication with a storage medium attached to a component attachable and detachable to and from a device body.

Replaceable components such as a toner container, various process units, a board, etc. are loaded in an image forming apparatus. Further, some image forming apparatuses are equipped with a storage medium for storing destination information and user information (for example, a number of prints). For such a storage medium, a radio frequency (RF) ID tag for contactless communication is typically adopted, so that information exchange with a reader and writer provided on an apparatus body side is performed.

SUMMARY

As one aspect of this disclosure, a technology obtained by further improving the technology described above will be suggested.

An electronic device according to one aspect of this disclosure includes: an attachable and detachable component, a communication section, a blocking control section, and a press mechanism.

The attachable and detachable component is attachable and detachable to and from a device body of the electronic device and is fitted with a storage medium.

The communication section communicates information with the storage medium.

The blocking control section blocks power supply to the communication section.

The press mechanism has a press member and a mover reciprocally moving in an attachment and detachment direction of the attachable and detachable component to and from the device body, and a support member including the mover therein and supporting the mover in a manner such that the mover is movable in the attachment and detachment direction.

The press member is pressed in conjunction with insertion of the attachable and detachable component.

The mover is formed in a manner such as to be, in conjunction with the press member, capable of reciprocally moving in the attachment and detachment direction from an initial position, which is a final end position of the support member, towards a first tip position located furthest inside of the support member and being locked at a middle position between the initial position and the first tip position in the attachment and detachment direction.

The blocking control section permits power supply for the communication upon movement of the mover to the first tip position and blocks the power supply for the communication upon movement of the mover to the middle position and the initial position.

An image forming apparatus according to one aspect of this disclosure includes the electronic device and an image formation section.

The image formation section forms an image on the storage medium.

The attachable and detachable component is a toner container refilling a toner in the image formation section.

DETAILED DESCRIPTION

Figure 1:
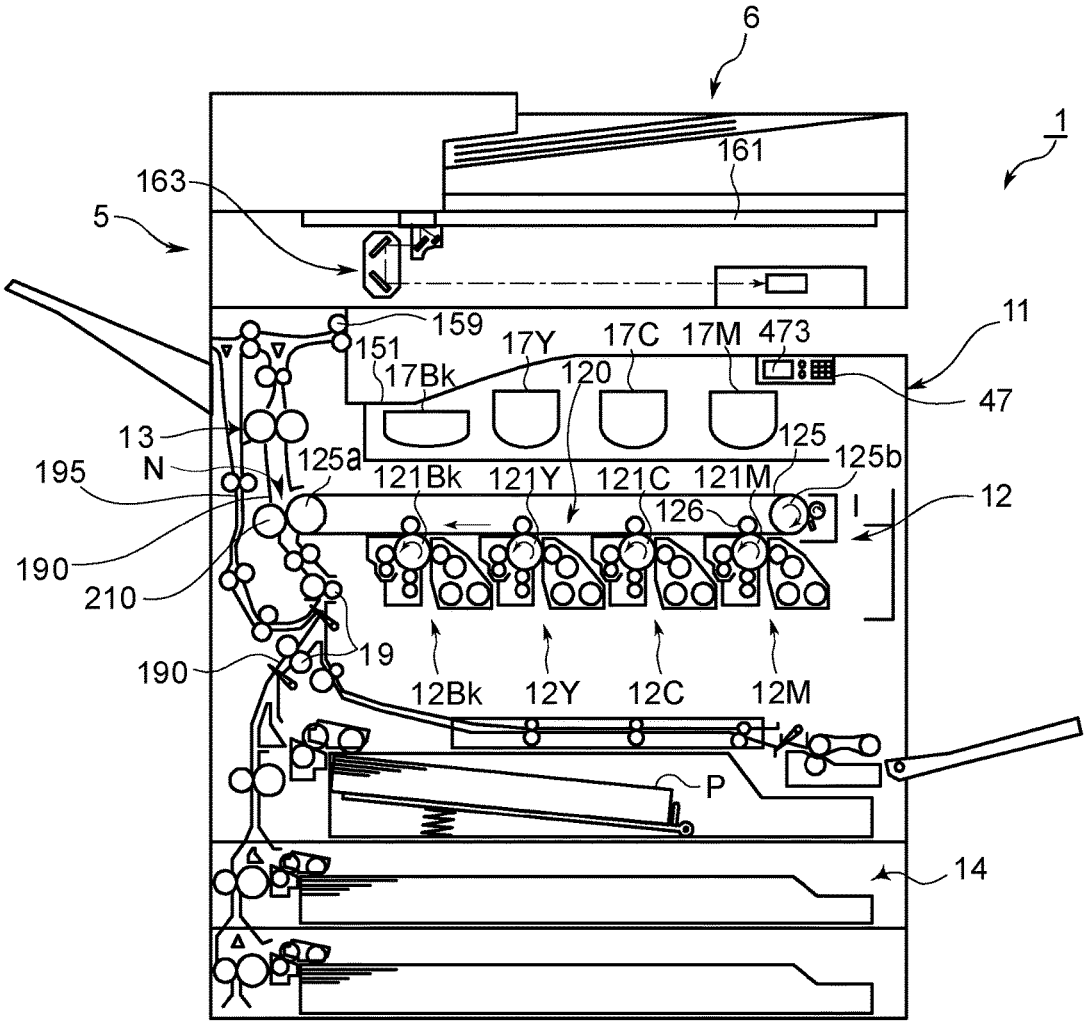
FIG. 1 is a partially sectional elevation view schematically showing a structure of an image forming apparatus as an electronic device according to a first embodiment of this disclosure.

Hereinafter, an electronic device and an image forming apparatus according to one embodiment of this disclosure will be described with reference to the drawings. FIG. 1 is a partially sectional elevation view schematically showing a structure of an image forming apparatus as an electronic device according to a first embodiment of this disclosure. The image forming apparatus 1 is, for example, a multi-function peripheral combining a plurality of functions such as a copy function, a printer function, a scanner function, and a facsimile function, and includes an operation section 47, a document feed section 6, and a document reading section 5 in an apparatus body 11.

The operation section 47 receives, from an operator, instructions such as an image formation operation execution instruction and a document reading operation execution instruction for various operations and processing executable by the image forming apparatus 1, and includes a display section 473 that displays, for example, an operation guide to the operator.

An image formation section 12 includes: a black (Bk) image formation unit 12Bk, a yellow (Y) image formation unit 12Y, a cyan (C) image formation unit 12C, and a magenta image (M) formation unit 12M. The image formation units 12Bk, 12Y, 12C, and 12M respectively include drum-type photoconductors 121Bk, 121Y, 121C, and 121M, which are driven into rotation counterclockwise in the figure.

Toner containers 17Bk, 17Y, 17C, and 17M respectively store black, yellow, cyan, and magenta toners, and are attachably and detachably fitted to a toner container fitting part (not shown) provided in the apparatus body 11 at a position separate from the photoconductors 121Bk, 121Y, 121C, and 121M thereabove with an intermediate transfer belt 125 in between.

A transfer unit 120 includes: the intermediate transfer belt 125 on an outer circumferential surface of which toner images are transferred; a driving roller 125*a*, a driven roller 125*b*, and a primary transfer roller 126.

The intermediate transfer belt 125 is stretched between the driving roller 125*a* and the driven roller 125*b*, is driven by the driving roller 125*a* while abutting circumferential surfaces of the photoconductors 121Bk, 121Y, 121C, and 121M, and endlessly runs synchronously with the photoconductors 121Bk, 121Y, 121C, and 121M.

A case where color printing is performed by the image forming apparatus 1 will be described. After periphery of the photoconductors 121Bk, 121Y, 121C, and 121M is evenly charged (a charging process), based on image data, laser light is irradiated to surfaces of the charged photoconductors 121Bk, 121Y, 121C, and 121M to form latent images (an exposure process), which are visualized by the toners (a developing process), so that the toner images formed through the visualization are transferred onto the intermediate transfer belt 125 by the primary transfer roller 126.

The toner images of the respective colors (black, yellow, cyan, and magenta) transferred onto the intermediate transfer belt 125 are superposed on each other on the intermediate transfer belt 125 through transfer timing adjustment, turning into a color toner image.

A secondary transfer roller 210 transfers, at a nip part N formed with the driving roller 125*a* with the intermediate transfer belt 125 in between, transfers the color toner image, which has been formed on the surface of the intermediate transfer belt 125, onto recording paper P conveyed from the paper feed section 14 through a conveyance path 190. The description provided up to this point refers to a case of color printing, and in case of black and white printing, the yellow photoconductor 121Y, the cyan photoconductor 121C, and the magenta photoconductor 121M are not used, and only the black photoconductor 121Bk is used.

A fixing section 13 fixes the toner image on the recording paper P through thermal compression, and the recording paper P which has been subjected to fixing processing and on which the color toner image has already been formed is discharged to a discharge tray 151.

Figure 2:
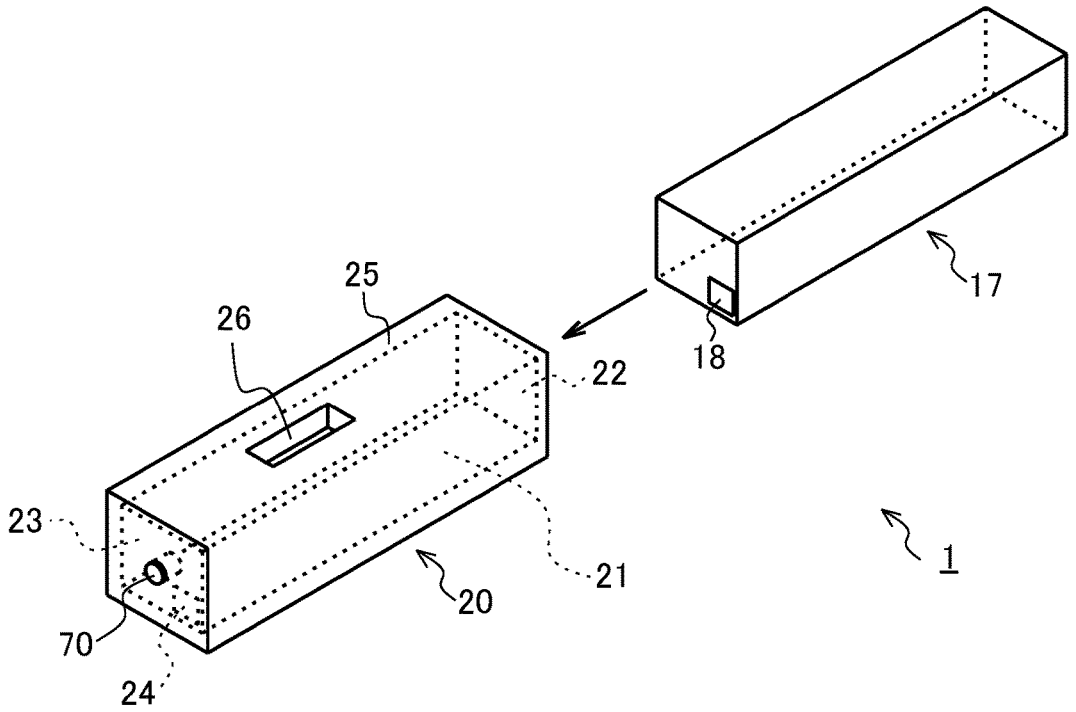
FIG. 2 is a perspective view schematically showing a toner container forming the image forming apparatus and a surrounding part thereof.

FIG. 2 is a perspective view schematically showing toner containers 17 (17Bk, 17Y, 17C, and 17M) and a surrounding part thereof. The toner containers 17 are attachable and detachable to and from the apparatus body 11 (FIG. 1). Provided in the image forming apparatus 1 is a toner container fitting part 20 for attachably and detachably fitting the toner containers 17. The toner containers 17 are each one example of an attachable and detachable component in the scope of the claims. Note that the image forming apparatus 1 may have the toner containers 17 as part of configuration thereof or not as the part thereof but as components separate therefrom.

At a tip side of the toner container 17 in an insertion direction thereof, an RFID tag 18 is attached which has a storage section (for example, a memory) storing destination information, user information, etc. The RFID tag 18 is one example of a storage medium in the scope of the claims.

Formed at the toner container fitting part 20 is a storage part 21 which stores the toner container 17 and which has: one end open and formed with an opening part 22; and another end closed. Upon storage of the toner container 17 in the storage part 21, the aforementioned tip side of the toner container 17 reaches a position close to a closed surface 23. Attached to the closed surface 23 at a position opposing the RFID tag 18 of the fitted toner container 17 is a reader and writer 24, which communicates information with the RFID tag 18 through short-distance wireless communication using radio waves. Formed on an upper wall 25 of the toner container fitting part 20 is a gap 26 into which a brake member 81 (FIGS. 6A and 6B) for regulating movement of the stored toner container 17 in a removal (separation) direction is inserted. The reader and writer 24 is one example of a communication section in the scope of the claims.

Formed at a bonding portion between the fitted toner container 17 and the toner container fitting part 20 is a press mechanism 30 (FIG. 3) to be described later on. A press member 70 forming the press mechanism 30 is projected to an inside of the storage part 21 and is arranged in a manner such as to be pressed in conjunction with insertion of the toner container 17.

Although not shown, toner refill ports are respectively formed on lower walls of the toner container 17 and the toner container fitting part 20, and upon fitting of the toner container 17 to the toner container fitting part 20, each toner refill port opens, so that a toner is refilled into the image formation section 12 (FIG. 1).

Figure 3:
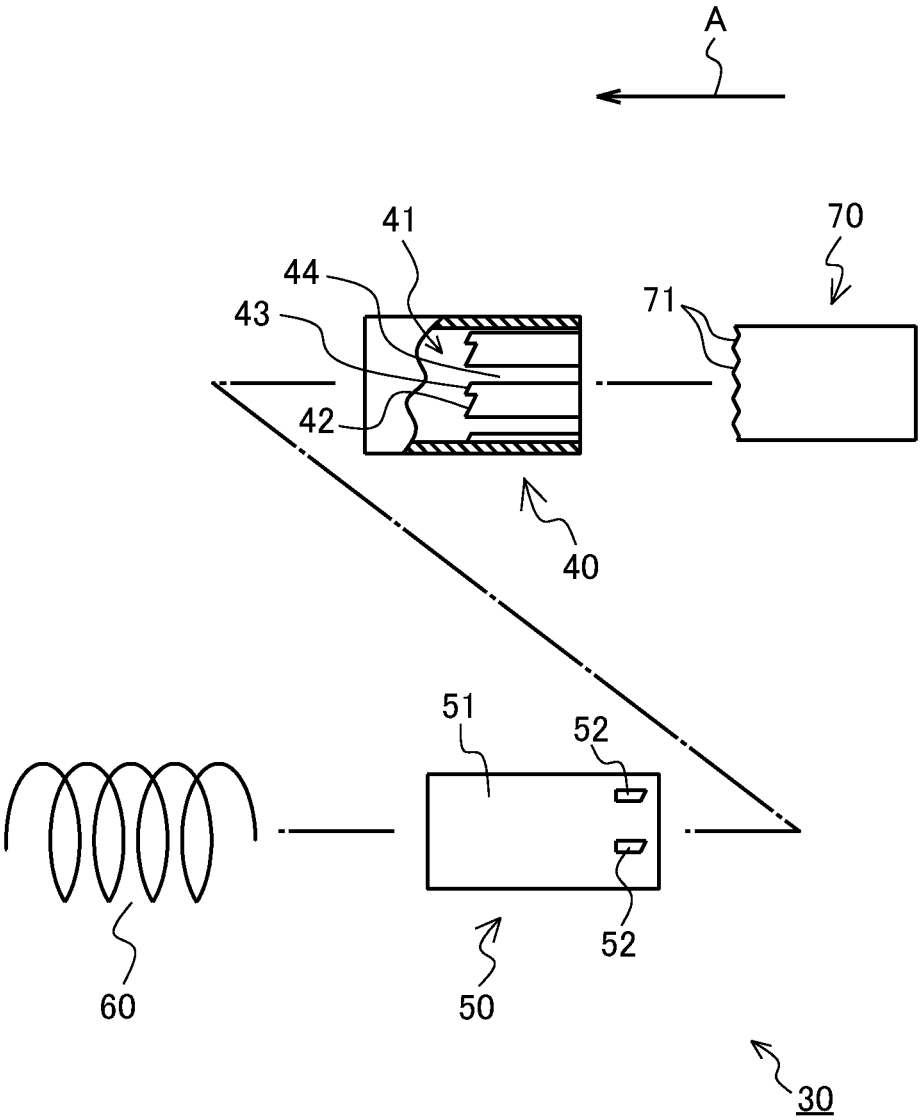
FIG. 3 is an exploded side view schematically showing a press mechanism formed at a bonding part between the toner container and a toner container fitting part.

FIG. 3 is an exploded side view schematically showing the press mechanism 30 formed at the bonding portion between the toner container 17 and the toner container fitting part 20. The press mechanism 30 includes a cylindrical member (support member) 40, a rotor 50, a spring (pressing member) 60, and the press member 70, and the press member 70 is pressed in a direction of arrow A in the figure (in the insertion direction of the toner container 17). Note that the rotor 50 is one example of a mover in the scope of the claims.

Formed near a rear end of an inner circumferential surface of the cylindrical member 40 is a cam groove (locking part) 41. At the cam groove 41, a first inclined cam 42, a second inclined cam 43, and a recess 44 are formed clockwise as viewed from a rear end side (a right end side in the figure). The first inclined cam 42, the second inclined cam 43, and the recess 44 are each formed in a plural number.

The rotor 50 is a member which includes a cylinder 51 of an inner diameter slightly smaller than that of the cylindrical member 40 and which is inserted to a tip side of the cylindrical member 40. Provided circumferentially at equal intervals at a rear end side of an outer circumferential surface of the cylinder 51 are a plurality of ribs (projections) 52 which are so formed as to be projected longitudinally and which engage with the cam groove 41 of the cylindrical member 40. Moreover, a spring 60 abuts a tip of the rotor 50, so that the rotor 50 is biased to a rear (in a direction opposite to the direction of arrow A). The press member 70 is disposed at an end part of the cylindrical member 40, opposite to an end part abutted by the spring 60, in a manner such as to be closely attached to the end part opposite to the end part abutted by the spring 60.

The press member 70 is a member which is formed into a substantially cylindrical shape of a diameter almost equal to the inner diameter of the cylindrical member 40 and which is inserted into a rear end side of the cylindrical member 40. When the toner container 17 (FIG. 2) has been pressed in the insertion direction (a fitting direction), the press member 70 is pressed in the direction of arrow A. Moreover, formed at a tip of the press member 70 is an inclined cam 71 that engages with the ribs 52 of the rotor 50.

Next, a system of the press mechanism 30 will be described with reference to FIGS. 4A to 4E and 5A to 5E.

Figure 4A:
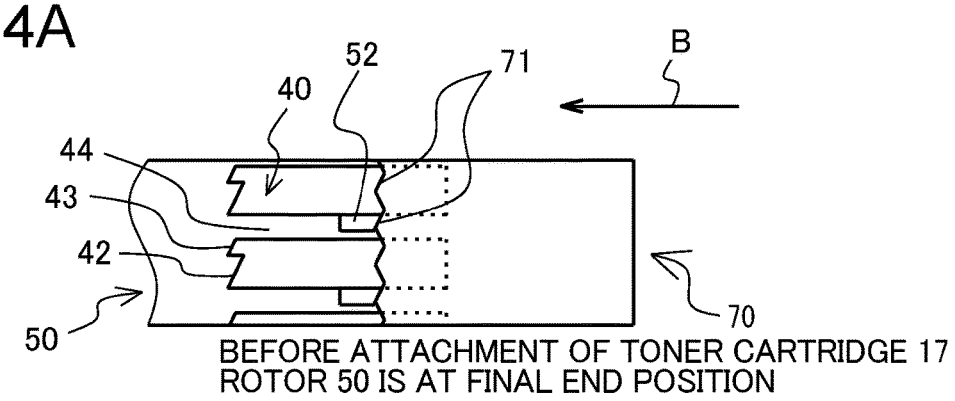
FIGS. 4A, 4B, 4C, 4D, and 4E are views illustrating a system of the press mechanism.

FIG. 4A shows a state before the toner container 17 (FIG. 2) is attached to the toner container fitting part 20 (FIG. 2), in which the press member 70 and the rotor 50 are present at final end positions as initial positions and the ribs 52 of the rotor 50 are pressed into the recess 44 of the cylindrical member 40, so that the ribs 52 of the rotor 50 engage with the inclined cam 71 of the press member 70.

Figure 4B:
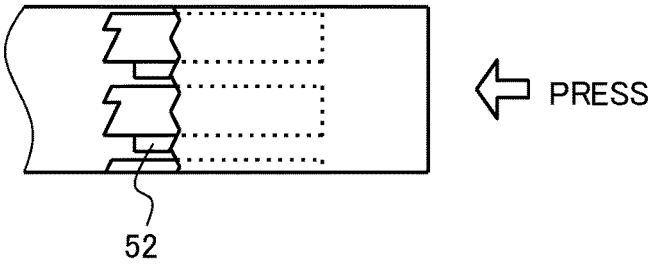
Figure 4C:
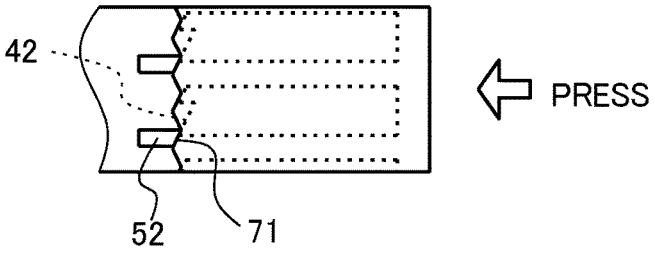

Upon pressing of the press member 70 in a direction of arrow B as a result of inserting the toner container 17 into the toner container fitting part 20 by an operator, the rotor 50 is pressed by the press member 70 in the direction of arrow B as shown in FIG. 4B, and upon pressing of the ribs 52 of the rotor 50 out to a position beyond the first inclined cam 42 of the cylindrical member 40 as shown in FIG. 4C, the ribs 52 slide on the inclined cam 71 of the press member 70 (the ribs 52 move upwardly in the figure), and the rotor 50 rotates clockwise as viewed from the rear end side.

Figure 4D:
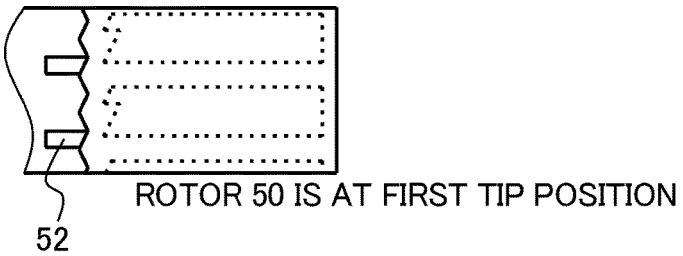

Then the press member 70 is further pressed, the press member 70 and the rotor 50 move in the direction of arrow B, and the press member 70 moves to a structural tip limit position to be released from being pressed (more specifically, the operator releases his or her hand from the toner container 17) as shown in FIG. 4D, upon which the rotor 50 is also released from being pressed by the press member 70, so that the rotor 50 moves in a direction opposite to the direction of arrow B by a biasing force of the spring 60. Then in conjunction therewith, the press member 70 also moves in the direction opposite to the direction of arrow B. Note that when the press member 70 has moved to the tip limit position, a position reached by the rotor 50 serves as a first tip position of the rotor 50.

Figure 4E:
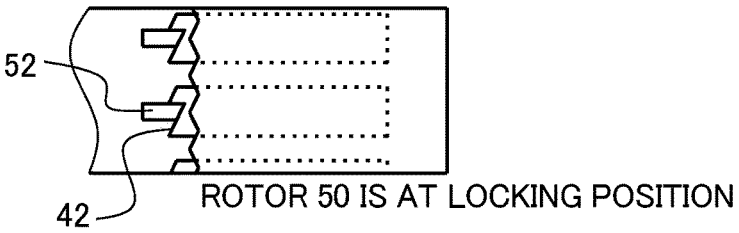

Upon reach of the ribs 52 of the rotor 50 at the first inclined cam 42 of the cylindrical member 40 as a result of movement of the rotor 50 in the direction opposite to the direction of arrow B, as shown in FIG. 4E, the ribs 52 slide on the first inclined cam 42 (the ribs 52 move upwardly in the figure), and the rotor 50 rotates clockwise as viewed from the rear end side. As a result, the ribs 52 engage with the first inclined cam 42, and the rotor 50 is locked. Note that a position where the locking described above is achieved is one example of a middle position in the scope of the claims.

Figure 5A:
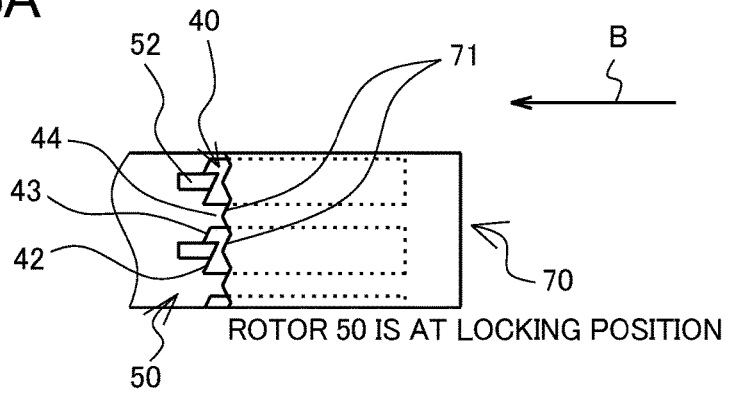
FIGS. 5A, 5B, 5C, 5D and 5E are views illustrating the system of the press mechanism.

FIG. 5A shows a state (FIG. 4E) in which the toner container 17 (FIG. 2) is attached to the toner container fitting part 20 (FIG. 2), in which the rotor 50 is present at a locking position, the ribs 52 of the rotor 50 engage with the first inclined cam 42 of the cylindrical member 40, and the rotor 50 is locked.

Figure 5B:
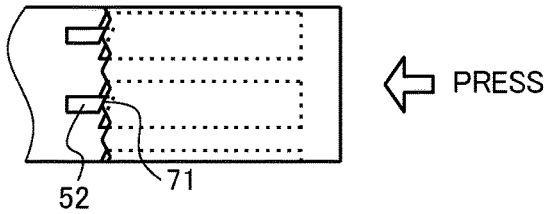

Upon pressing of the toner container 17 in the insertion direction by the operator from the aforementioned state, the press member 70 is pressed in the direction of arrow B, and upon arrival of the inclined cam 71 of the press member 70 at the first inclined cam 42 of the cylindrical member 40 as shown in FIG. 5B, the inclined cam 71 of the press member 70 abuts the ribs 52 of the rotor 50 and the rotor 50 is pressed by the press member 70 in the direction of arrow B.

Upon pressing of the rotor 50 in the direction of arrow B, the engagement between the ribs 52 of the rotor 50 and the first inclined cam 42 of the cylindrical member 40 is released, the ribs 52 of the rotor 50 slide on the inclined cam 71 of the press member 70 (the ribs 52 move upwardly in the figure), and the rotor 50 rotates clockwise as viewed from the rear end side.

Figure 5C:
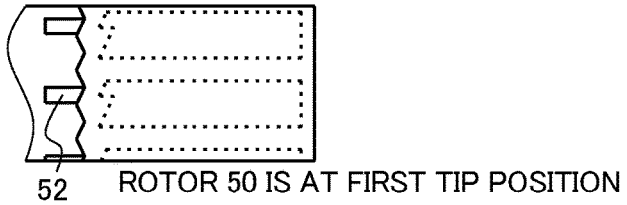

Subsequently, the press member 70 is further pressed, the press member 70 and the rotor 50 move in the direction of arrow B, and, as shown in FIG. 5C, the press member 70 moves to a structural tip limit position to be released from being pressed (more specifically, the operator releases his or her hand from the toner container 17), upon which the rotor 50 is also released from being pressed by the press member 70, so that the rotor 50 moves in the direction opposite to the direction of arrow B by the biasing force of the spring 60. Then in conjunction therewith, the press member 70 also moves in the direction opposite to the direction of arrow B. Note that, as described above, when the press member 70 has moved to the tip limit position, the position reached by the rotor 50 serves as the first tip position of the rotor 50.

Figure 5D:
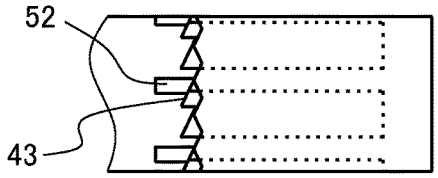

Upon reach of the ribs 52 of the rotor 50 at the second inclined cam 43 of the cylindrical member 40 as a result of the movement of the rotor 50 in the direction opposite to the direction of arrow B, as shown in FIG. 5D, the ribs 52 slide on the second inclined cam 43 (the ribs 52 move upwardly in the figure) and the rotor 50 rotates clockwise as viewed from the rear end side.

Figure 5E:
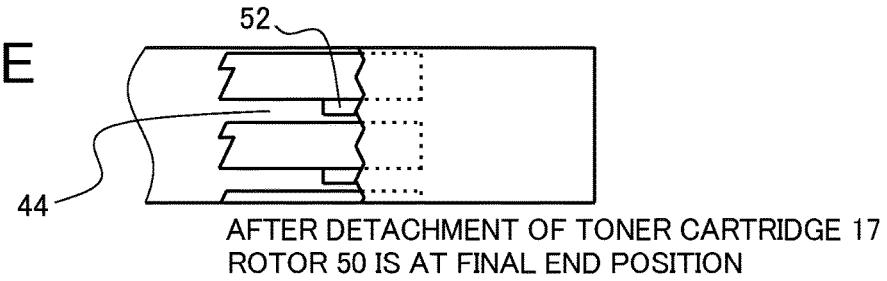

Upon movement of the ribs 52 of the rotor 50 to the recess 44 as a result of the sliding of the ribs 52 of the rotor 50 on the second inclined cam 43 and detachment thereof from the second inclined cam 43, as shown in FIG. 5E, nothing inhibits the movement of the ribs 52, so that the rotor 50 moves to a final end position by the biasing force of the spring 60. Then in conjunction therewith, the press member 70 also moves in the direction opposite to the direction of arrow B, and the toner container 17 is pressed out of the toner container fitting part 20 by the press member 70. This makes it easy to take out the toner container 17.

As described above, the rotor 50 is formed in a manner such as to be, as a result of being pressed by the press member 70, capable of making reciprocal movement in the attachment and detachment direction of the toner container 17 and capable of being locked at a middle position in a range of the reciprocal movement (between the final end position and the first tip position).

Figure 6A:
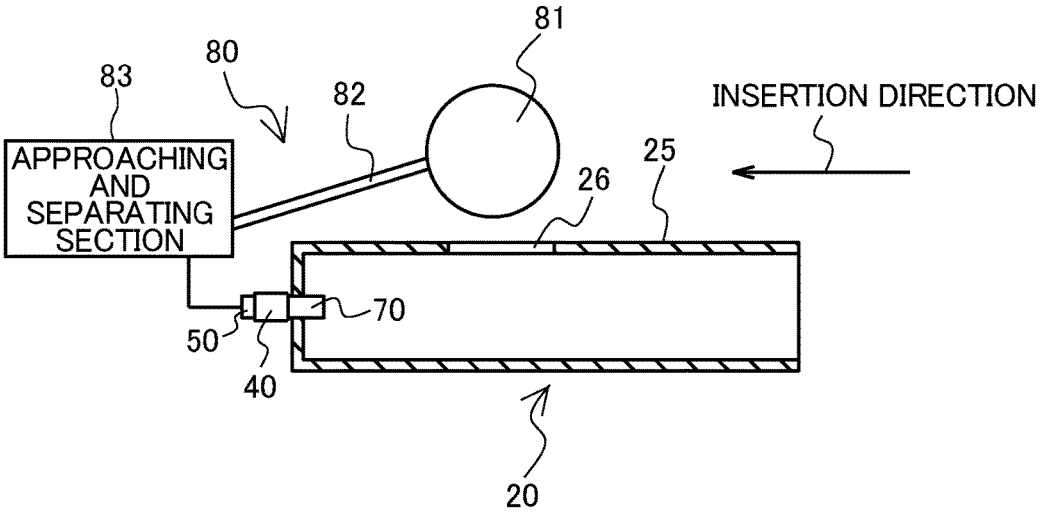
FIGS. 6A and 6B are partially sectional side views schematically showing a surrounding part of the toner container fitting part.
Figure 6B:
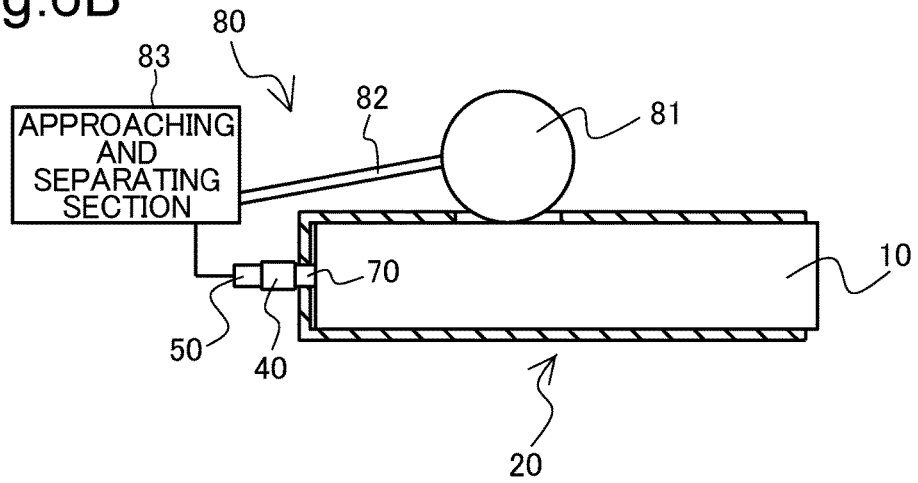

FIGS. 6A and 6B are partially sectional side views schematically showing a surrounding part of the toner container fitting part 20. A regulation section 80 that regulates movement in the separation direction of the toner container 17 includes: the brake member 81 inserted in the gap 26 formed on the upper wall 25 of the toner container fitting part 20; a holding member 82 holding the brake member 81; and an approaching and separating section 83 moving the brake member 81 in a direction approaching and separating to and from the toner container 17 through control of the holding member 82.

The approaching and separating section 83 is so formed as to move in conjunction with movement of the rotor 50, and upon locking of the rotor 50 as a result of engagement of the ribs 52 of the rotor 50 with the first inclined cam 42 of the cylindrical member 40, the brake member 81 controls the holding member 82 in a direction making contact with the toner container 17 (FIG. 6B), and upon release of the rotor 50 from a locked state, the brake member 81 controls the holding member 82 in the direction separating from the toner container 17 (FIG. 6A). In the embodiment, known techniques are used as a technology of regulating movement by utilizing a press mechanism. As a result, in a state in which the press member 70 is being pressed as a result of fitting the toner container 17 to the toner container fitting part 20, the brake member 81 makes contact with the toner container 17 to suppress movement of the toner container 17 in the aforementioned attachment and detachment direction. Moreover, in a state in which the press member 70 is not being pressed as a result of detachment of the toner container 17 from the toner container fitting part 20, the brake member 81 separates from the toner container 17, so that the toner container 17 becomes smoothly movable in the aforementioned attachment and detachment direction.

Figure 7:
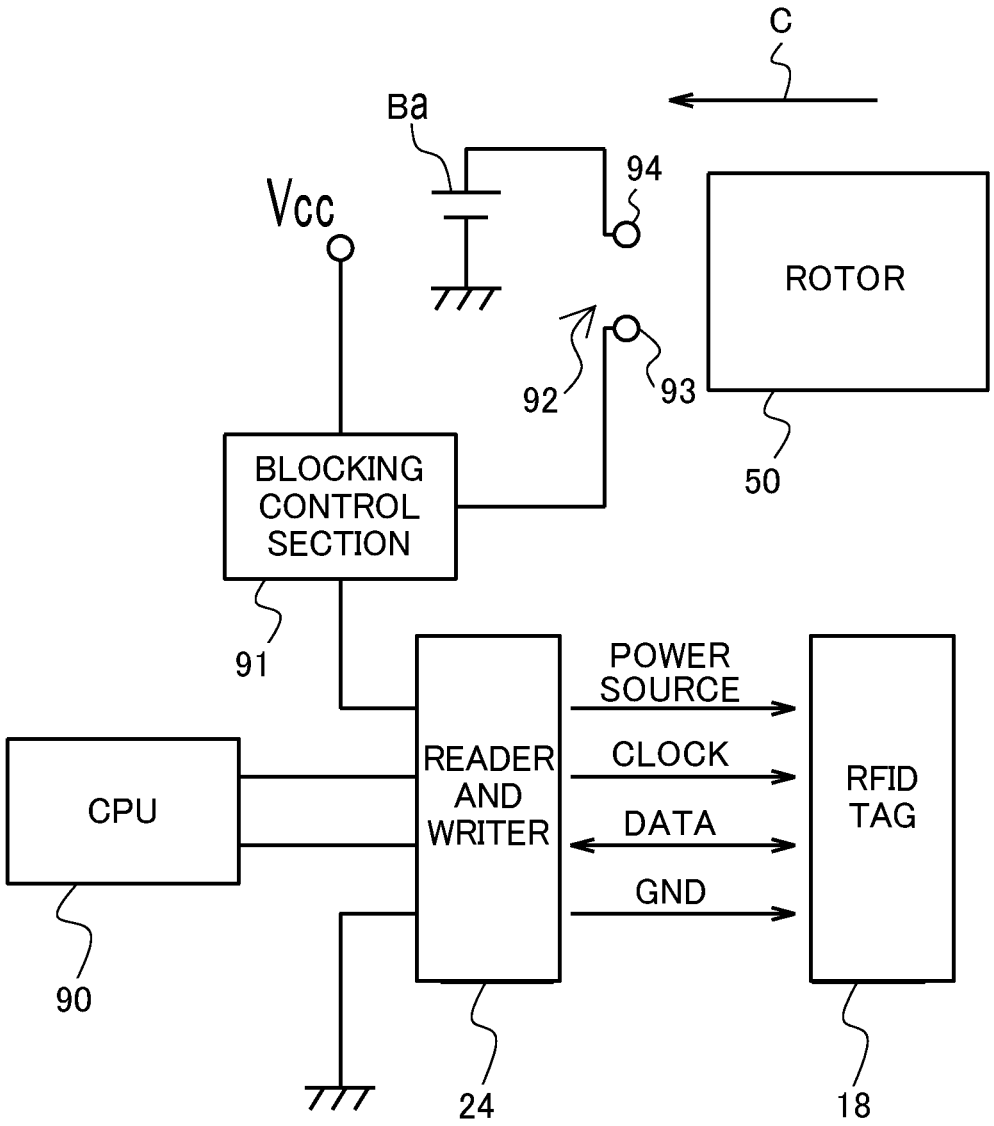
FIG. 7 is a diagram showing inner configuration in a surrounding part of an RFID tag and a reader and writer.

FIG. 7 is a diagram showing inner configuration of a surrounding part of the RFID tag 18 and the reader and writer 24 of the image forming apparatus 1. A central processing unit (CPU) 90 is in charge of control of the image forming apparatus 1, and performs information exchange with the RFID tag 18 via the reader and writer 24. The reader and writer 24 is connected to a VCC power source with a blocking control section 91 in between and is also grounded.

Wireless communication is performed between the RFID tag 18 and the reader and writer 24 by using radio waves, and when a distance between the both is no greater than a maximum communicable distance S1, the communication is enabled. The reader and writer 24 transmits a power supply signal, a clock signal, and a ground signal (GND) to the RFID tag 18, and also performs data reading and writing on the RFID tag 18.

As shown in FIGS. 4D and 5C, the rotor 50 moves to the first tip position when, in conjunction with insertion of the toner container 17 (FIG. 2), the press member 70 has been pressed in the direction of arrow B and the press member 70 has moved to the first tip position, that is, when a distance between the RFID tag 18 attached to the toner container 17 and the reader and writer 24 attached to the closed surface 23 of the toner container fitting part 20 is shortest.

Then the press mechanism 30 is so formed as to establish relationship "L1<the maximum communicable distance S1 where the aforementioned distance is defined as L1. Alternatively, an RFID tag 18 and a reader and writer 24 are adopted which have the maximum communicable distance S1 satisfying the relationship "L1<the maximum communicable distance S1.

The blocking control section 91 shown in FIG. 7 blocks power supply to the reader and writer 24, and is connected to a battery Ba via a connection switching section 92. The connection switching section 92 includes terminals 93 and 94.

The rotor 50 is conductively formed and movable in a direction of arrow C (the insertion direction of the toner container 17). Upon movement of the rotor 50 to the first tip position, the rotor 50 makes contact with the terminals 93 and 94, and electric connection is formed between the blocking control section 91 and the battery Ba, so that an electric signal flows to the blocking control section 91. On the other hand, upon movement of the rotor 50 to the locking position as a result of movement of the rotor 50 in a direction opposite to the direction of arrow C and separation of the rotor 50 from the first tip position, the rotor 50 separates from the terminals 93 and 94, releasing the electric connection between the blocking control section 91 and the battery Ba.

The blocking control section 91 supplies power to the reader and writer 24 upon intake of the aforementioned electric signal (upon the movement of the rotor 50 to the first tip position), and blocks the power supply to the reader and writer 24 in other occasions.

Thus, when the rotor 50 has moved to the first tip position as shown in FIGS. 4D and 5C, a distance between the RFID tag 18 attached to the toner container 17 and the reader and writer 24 is within a communicable range, and when the rotor 50 has moved to the locking position (middle position) as shown in FIGS. 4E and 5A, the distance between the RFID tag 18 and the reader and writer 24 is out of the communicable range.

According to the embodiment described above, in conjunction with the insertion of the attachable and detachable toner container 17 into the apparatus body 11, the press member 70 is pressed and, in conjunction therewith, the rotor 50 moves to the first tip position, upon which communication between the RFID tag 18 attached to the toner container 17 and the reader and writer 24 is enabled. On the other hand, upon movement of the rotor 50 to the middle position as a result of separation thereof from the first tip position, the communication between the RFID tag 18 and the reader and writer 24 is disabled.

As a result, the communication between the both is enabled only upon performance of an action of inserting the toner container 17 and an action of detaching the toner container 17 (that is, only upon replacement of the toner container 17, which requires information exchange). Therefore, the communication between the RFID tag 18 and the reader and writer 24 is performed only when necessary, which can therefore prevent unnecessary power consumption. Moreover, timing at which the power supply is required is judged by a mechanical mechanism of the movement of the rotor 50, which therefore requires no judgment on a software side and no new addition of a CUP port for power supply blocking.

Specifically, the information exchange between the RFID tag 18 and the reader and writer 24 is not necessarily performed constantly during operation of the image forming apparatus 1 and may be performed upon component replacement, which raises no problem resulting from usage in many cases. However, in a typical image forming apparatus, power is constantly supplied for the purpose of communication with a storage medium during operation of the apparatus, thus resulting in unnecessary power consumption. Examples of methods of addressing such a problem include a method of judging, by a CPU, timing at which information exchange is required and causing the CPU to make control in a manner such as to avoid the power supply to the RFID tag in other occasions. With such a method, it is required to prepare a new CPU port for power supply blocking. On the contrary, according to the embodiment described above, it is possible to prevent unnecessary power consumption without adding a new CPU port.

Figure 8:
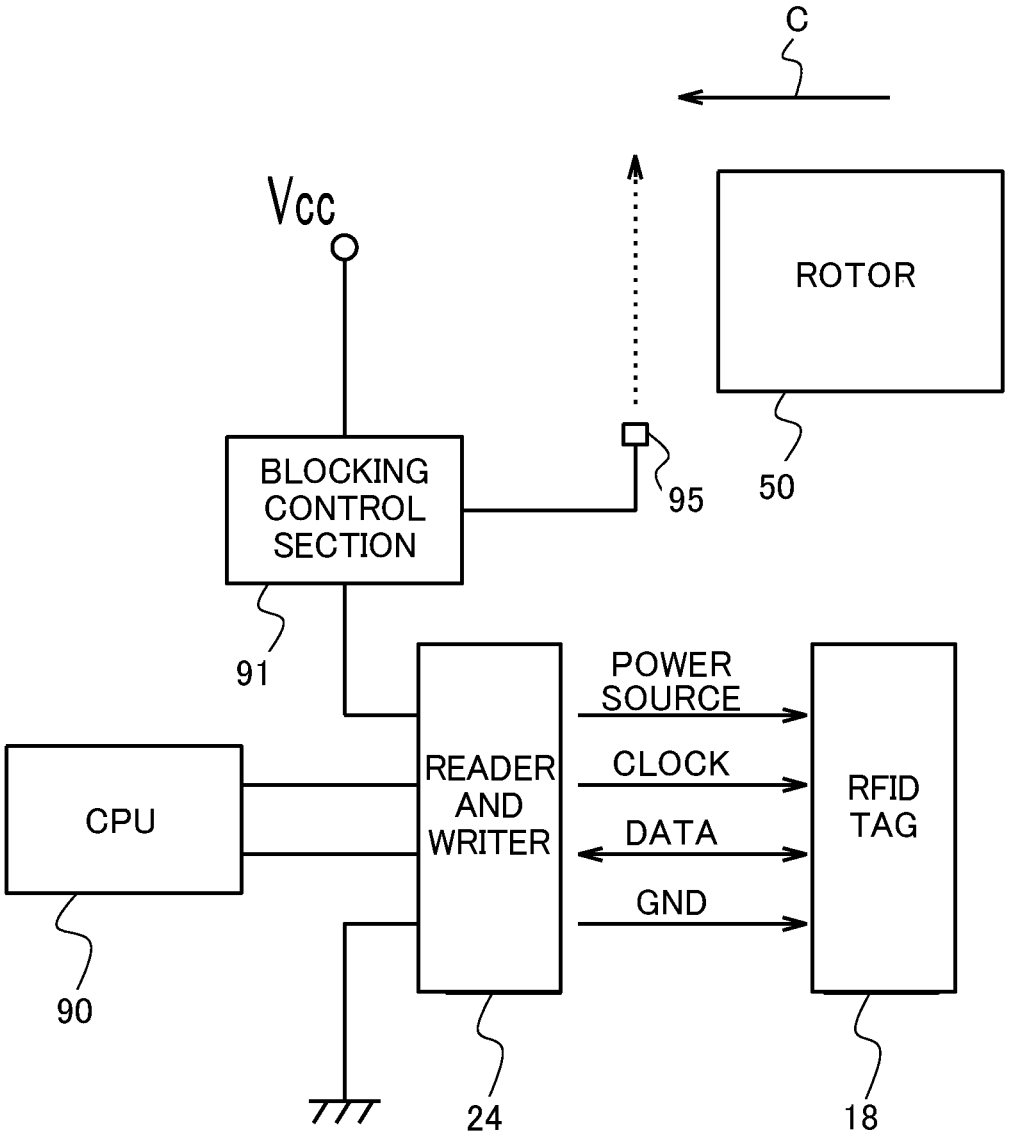
FIG. 8 is a diagram showing inner configuration in a surrounding part of an RFID tag and a reader and writer according to a second embodiment.

FIG. 8 is a view showing inner configuration in a surrounding part of an RFID tag 18 and a reader and writer 24 of an image forming apparatus 1 according to a second embodiment. As described above, a press mechanism 30 is so formed as to establish relationship L1<maximum communicable distance S1. Alternatively, an RFID tag 18 and a reader and writer 24 are adopted which provide the maximum communicable distance S1 satisfying the relationship L1<maximum communicable distance S1. Note that the same components as those in the inner configuration shown in FIG. 7 are provided with the same reference numerals and are omitted here from a detailed description.

A blocking control section 91 blocks power supply to the reader and writer 24, and is connected to a photo interpreter (PI) sensor 95. The PI sensor 95 includes a light emitting section and a light receiving section, and determines presence or absence of any object near a first tip position of a rotor 50 through detection of blockage of light from the light emitting section. Note that the PI sensor is one example of a mover detection section in the scope of the claims.

The rotor 50 is movable in a direction of arrow C (in an insertion direction of the toner container 17). Upon movement of the rotor 50 to a first tip position, the PI sensor 95 detects the rotor 50, and outputs an electric signal to the blocking control section 91. On the other hand, when the rotor 50 has moved in a direction opposite to the direction of arrow C, has separated from the first tip position, and has moved to the locking position, the PI sensor 95 does not detect the rotor 50, so that the PI sensor 95 outputs no electric signal to the blocking control section 91.

The blocking control section 91 supplies power to the reader and writer 24 upon intake of the electric signal (upon movement of the rotor 50 to the first tip position), and blocks the power supply to the reader and writer 24 in other occasions.

Thus, in a case where the rotor 50 has moved to the first tip position as shown in FIGS. 4D and 5C, communication between the RFID tag 18 attached to the toner container 17 and the reader and writer 24 is enabled. In a case where the rotor 50 has moved to a locking position (middle position) as shown in FIGS. 4E and 5A, the communication between the RFID tag 18 and the reader and writer 24 is disabled.

The above embodiment has been described, referring to a case where the press mechanism 30 is formed in the apparatus body 11, but the press mechanism 30 may be formed in the toner container 17.

This disclosure is not limited to the configuration of the embodiments described above and various modifications can be made to this disclosure. Moreover, the above embodiments have been described, referring to a multifunction peripheral of an image forming apparatus as one embodiment of an electronic device according to this disclosure. However, this is only one example, and any other electronic device, for example, an image forming apparatus having a copy function, a printer function, a scanner function, and a facsimile function is also applicable.

The configuration and processing shown by the above embodiments with reference to FIGS. 1 through 8 are only one embodiment of this disclosure, and thus this disclosure is not limited to the configuration and processing described above.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An electronic device comprising:

an attachable and detachable component being attachable and detachable to and from a device body of the electronic device and being fitted with a storage medium;

a communication section communicating information with the storage medium;

a blocking control section blocking power supply to the communication section; and a press mechanism having a press member and a mover reciprocally moving in an attachment and detachment direction of the attachable and detachable component to and from the device body, and a support member including the mover therein and supporting the mover in a manner such that the mover is movable in the attachment and detachment direction, wherein the press member is pressed in conjunction with insertion of the attachable and detachable component, the mover is formed in a manner such as to be, in conjunction with the press member, capable of reciprocally moving in the attachment and detachment direction from an initial position, which is a final end position of the support member, towards a first tip position located furthest inside of the support member and being locked at a middle position between the initial position and the first tip position in the attachment and detachment direction, and the blocking control section permits power supply for the communication upon movement of the mover to the first tip position and blocks the power supply for the communication upon movement of the mover to the middle position and the initial position.

2. The electronic device according to claim 1, further comprising a connection switching section being connected between a battery and the blocking control section and having two open terminals, the connection switching section being capable of switching between electrical connection and disconnection, and the mover is formed of a conductive material, and upon the movement of the mover to the first tip position, the mover makes contact with the two terminals of the connection switching section to achieve conduction between the two terminals, and the blocking control section starts the power supply for the communication upon the electrical connection of the battery to the blocking control section through the conduction.

3. The electronic device according to claim 2, wherein the mover has, provided on an outer circumferential surface thereof, a radially projected projection, the press mechanism is provided with a pressing member attached to an end part of the mover, the end part being a side of the first tip position, the pressing member pressing the mover in inside of the support member in the attachment and detachment direction toward the initial position, a locking part is provided on an inner circumferential surface of the support member, the locking part locking the projection, limiting the pressing by the pressing member, suppressing the movement of the mover in the attachment and detachment direction, and keeping the mover at the middle position, the press member is disposed at an end part of the mover opposite to the end part, a side of which is where the pressing member is attached, in a manner such as to be closely attached to the end part opposite to the end part of the mover, when subjected to the pressing as a result of the insertion of the attachable and detachable component, the press member presses and moves the mover to the first tip position in a direction opposite to the direction toward the initial position, and when released from the pressing by the press member, the mover moves in the direction toward the initial position through the pressing by the pressing member, and the projection is locked at the locking part.

4. The electronic device according to claim 1, further comprising a mover detection section having an optical sensor and detecting presence or absence of the mover at the first tip position in a contactless manner, wherein the blocking control section supplies the power for the communication upon detection of the presence of the mover at the first tip position of the mover by the mover detection section.

5. The electronic device according to claim 1, comprising a regulation section regulating movement of the attachable and detachable component in an attachment and detachment direction, wherein upon the locking of the mover at the middle position, the movement of the attachable and detachable component in the attachment and detachment direction is regulated by the regulation section.

6. An electronic device comprising:

a communication section communicating information with a storage medium attached to an attachable and detachable component being attachable and detachable to and from a device body of the electronic device;

a blocking control section blocking power supply to the communication section; and a press mechanism having a press member and a mover reciprocally moving in an attachment and detachment direction of the attachable and detachable component to and from the device body, and a support member including the mover therein and supporting the mover in a manner such that the mover is movable in the attachment and detachment direction, wherein the press member is pressed in conjunction with insertion of the attachable and detachable component, the mover is formed in a manner such as to be, in conjunction with the press member, capable of reciprocally moving in the attachment and detachment direction from an initial position, which is a final end position of the support member, towards a first tip position located furthest inside of the support member and being locked at a middle position between the initial position and the first tip position in the attachment and detachment direction, and the blocking control section permits power supply for the communication during movement of the mover to the first tip position, and blocks the power supply for the communication during movement of the mover to the middle position and the initial position.

7. An image forming apparatus comprising:

the electronic device according to claim 1; and an image formation section forming an image on the storage medium, wherein the attachable and detachable component is a toner container refilling a toner to the image formation section.

* * * * *